US007105991B2

(12) United States Patent
Egger et al.

(10) Patent No.: US 7,105,991 B2
(45) Date of Patent: Sep. 12, 2006

(54) SPARK PLUG WITH SEALING RING AROUND CENTER ELECTRODE

(75) Inventors: Christoph Egger, Jenbach (AT); Christian Francesconi, Bruck a. d. Mur (AT)

(73) Assignee: Jenbacher Aktiengesellschaft, (AT)

( * ) Notice: Subject to any disclaimer, the term of this patent is extended or adjusted under 35 U.S.C. 154(b) by 0 days.

(21) Appl. No.: 10/625,197

(22) Filed: Jul. 22, 2003

(65) Prior Publication Data

US 2005/0174026 A1 Aug. 11, 2005

(30) Foreign Application Priority Data

Jul. 22, 2002 (AT) ..... A 1107/2002

(51) Int. Cl.
*H01T 13/20* (2006.01)

(52) U.S. Cl. ..... 313/143; 313/118; 313/141

(58) Field of Classification Search ..... 313/118, 313/119, 132, 135, 137, 141, 143; 123/169 EL, 123/169 E, 169 P
See application file for complete search history.

(56) References Cited

U.S. PATENT DOCUMENTS 3,567,987 A * 3/1971 Schnurmacher ..... 313/123
3,569,765 A * 3/1971 Moray ..... 313/136
4,136,259 A 1/1979 Djeddah ..... 174/152 S
4,193,012 A * 3/1980 Podiak et al. ..... 313/137
4,563,158 A 1/1986 Meyer ..... 445/7
5,569,971 A 10/1996 Clifford et al. ..... 313/141

FOREIGN PATENT DOCUMENTS

FR 919 328 3/1947
JP 01-289084 11/1989

OTHER PUBLICATIONS

European Search Report for related European Application No. EP 03 01 4237 (Nov. 28, 2003).

* cited by examiner

*Primary Examiner*—Joseph Williams
*Assistant Examiner*—Kevin Quarterman
(74) *Attorney, Agent, or Firm*—Lorusso & Associates

(57) ABSTRACT

A spark plug is disclosed. The spark plug has a ceramic insulator body and a center electrode that is housed at least partially in a bore in the insulator body. The center electrode is sealed off from the insulator body by at least one sealing ring surrounding the center electrode that contains material that is plastically deformable by compression.

14 Claims, 2 Drawing Sheets

SPARK PLUG WITH SEALING RING AROUND CENTER ELECTRODE

BACKGROUND OF THE INVENTION

The present invention relates to a spark plug with an, in particular ceramic, insulator body and a center electrode, wherein said center electrode is housed at least partially in a bore in said insulator body, said center electrode being sealed off from said insulator body—preferably exclusively—by at least one sealing ring surrounding said center electrode.

In the state of the art, spark plugs have highly varied configurations of center and base electrodes. As a rule, the center electrode is guided in a bore in an insulator and projects beyond this on the combustion-chamber side. The seal between the center electrode and the insulator body, which is also decisive for the longevity and compressive strength of the spark plugs among other things, is normally realized by introducing glass-like or other sealing compounds between the center electrode and the insulator body. It is important that the sealing compound creates a gas-tight connection.

This way of sealing known in the state of the art has the disadvantage that it is relatively costly to introduce the sealing compound between the center electrode and the insulator body such that the desired gas-tight seal is ensured.

A glass seal in the form of a ring made of presintered glass powder is known from U.S. Pat. No. 4,563,158. The ring is pushed onto the center electrode. Then the glass powder is melted during exposure to heat and simultaneously pushed into its final position.

If these spark plugs known today are used in internal combustion engines, such as e.g. high-powered engines with very high internal pressures in the combustion chamber, the problem often arises that the spark plugs do not permanently have the required compressive strength. This can result either in gas escaping or the center electrode being pushed out of the insulator body during the operation of the internal combustion engine or being expelled at high pressure, which can in turn pose a risk for people and the machine.

BRIEF SUMMARY OF THE INVENTION

The object of the present invention is therefore to make available a spark plug which has the desired compressive strength.

This is achieved according to the invention in that said sealing ring contains material that is plastically deformable by compression.

The seal according to the invention firstly has the advantage that the manufacture of the spark plug according to the invention is clearly simplified compared with the state of the art. In addition, a very durable and high-pressure-resistant seal is created between the center electrode and the insulator body by the sealing ring(s) that is (are) plastically deformable preferably at room temperature (approx. 20° C.). The use of further sealing means for sealing off the center electrode from the insulator body can preferably be dispensed with, the sealing ring or sealing rings alone creating an adequate seal with high compressive strength.

The sealing rings to be used for this can in principle be made from various types of material. The sealing ring preferably contains at least one metal or one alloy of metals. A particularly durable seal with high compressive strength is achieved if the sealing ring contains soft iron and/or copper and/or nickel and/or high-grade steel and/or aluminum materials and/or alloys of these materials.

Both the use of only one sealing ring and the use of two or more sealing rings can be provided for. The sealing ring(s) can be arranged at various points inside and outside the insulator body. A first variant provides that a sealing ring rests against the insulator body at its end which, in the fitted position of the spark plug, points to a combustion chamber of an internal combustion engine, a seal with particularly high compressive strength again being achieved if a sealing ring rests against the insulator body in a recess of same partially covering the sealing ring.

It is already known in the state of the art to push and/or to press and/or to weld and/or otherwise to attach a so-called center electrode carrier onto the end of the center electrode which, in the fitted position, points to a combustion chamber of an internal combustion engine. In the case of such spark plugs, it is mostly favorable if a sealing ring is arranged, preferably clamped, between the center electrode carrier and the insulator body. Alternatively to the center electrode carrier which is comparatively expensive and to be treated with care, it can also be provided that an attachment ring is pushed and/or pressed and/or welded and/or the like onto the end of the center electrode that points to a combustion chamber of an internal combustion engine, a sealing ring again being arranged, preferably clamped, between the attachment ring and the insulator body. If no center electrode carrier and no attachment ring are provided, the center electrode can alternatively also have outside the insulator body an area of enlarged diameter at its end which, in the fitted position of the spark plug, points to the combustion chamber of an internal combustion engine, a sealing ring then being able to be arranged or preferably clamped between the area with enlarged diameter and the insulator body.

In addition to these variants in which a sealing ring is arranged at the combustion-chamber side end, of the insulator body, it can be provided instead of or even in addition to this that at least one sealing ring lies inside the insulator body. A favorable variant again provides that a sealing ring is arranged, preferably clamped, inside the insulator body between a shoulder, surrounding the center electrode, of the insulator body and an area of enlarged diameter of the center electrode.

As already mentioned, it is a major advantage of the different variants of the spark plug according to the invention that they can be manufactured particularly rapidly and easily. A process provided for this can comprise the following steps:

a) Introduction of the center electrode into the bore provided for this in the insulator body, at least one sealing ring, preferably all sealing rings, being arranged at the point provided for it (them), b) Compression of the center electrode with the insulator body, the sealing ring(s) sealing off the center electrode from the insulator body and being plastically deformed.

In the case of spark plugs which have a center electrode carrier and/or at least one attachment ring, it is again favorable if during or after process step b) a center electrode carrier and/or at least one attachment ring is pushed and/or pressed and/or welded onto the end of the center electrode which, in the fitted position of the spark plug, points to the combustion chamber of an internal combustion engine, the sealing ring sealing off between the center electrode carrier and/or the attachment ring on the one side and the insulator body on the other side, and being plastically deformed.

BRIEF DESCRIPTION OF THE SEVERAL VIEWS OF THE DRAWING

Further details and features of the present invention result from the following description of the figures. There are shown in.

DETAILED DESCRIPTION OF THE INVENTION

Figure 1:
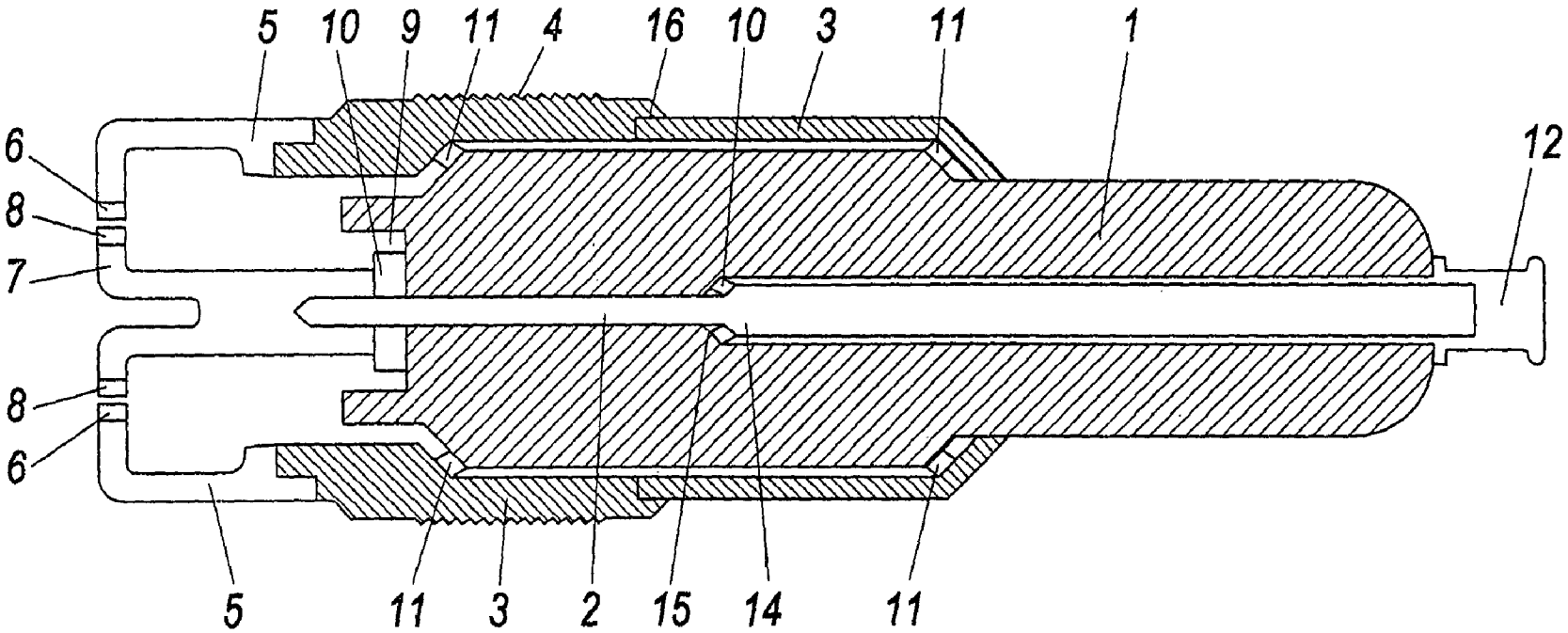
FIG. 1 a first variant of a spark plug according to the invention with a center electrode carrier, and FIG. 2 a second variant according to the invention without a center electrode carrier.

The spark plug represented in a longitudinal section in FIG. 1 has, as is known in the state of the art, an insulator body 1 with a bore into which a center electrode 2 is inserted. The insulator body 1 is covered by the spark plug housing 3 and is sealed off from this by means of the seals 11 in a gas-tight and compression-resistant manner. The spark plug housing 3 has a thread 4 for screwing the spark plug into the cylinder head. Furthermore, a spark plug connector socket 12 is provided at the rear end of the center electrode 2. An ground electrode carrier 5 is pushed in an electrically conducting manner onto the spark plug housing 3 at the combustion-chamber side end of the spark plug and a center electrode carrier 7 is connected in an electrically conducting manner to the center electrode 2. The center electrode 2 and the center electrode carrier 7 are connected as known in the state of the art favorably by fitting the center electrode carrier 7 onto the center electrode 2 and then compressing and welding the two components. The ignition sparks are created upon the operation of the spark plug between the electrodes 8 of the center electrode carrier 7 and the ground electrodes 6, which are pushed in an electrically conducting manner onto the ground electrode carrier 5.

According to the invention, it is now provided that the center electrode 2 is sealed off from the insulator body 1 preferably exclusively by means of the sealing rings 10. Such a sealing ring 10 is located in the recess 9 of the insulator body 1 and is clamped between the center electrode carrier 7 and the insulator body 1. A second sealing ring is clamped between a shoulder 15 inside the insulator body 1 and an area 14 of the center electrode 2 with enlarged diameter. Upon the clamping of the sealing rings, the latter are plastically deformed, resulting in a particularly good seal. Due to the arrangement of the sealing rings 10 according to the invention shown on this embodiment, the use, known in the state of the art, of various e.g. glass-like sealing compounds for sealing off between the center electrode and the insulator body 1 can preferably be totally dispensed with.

Figure 2:
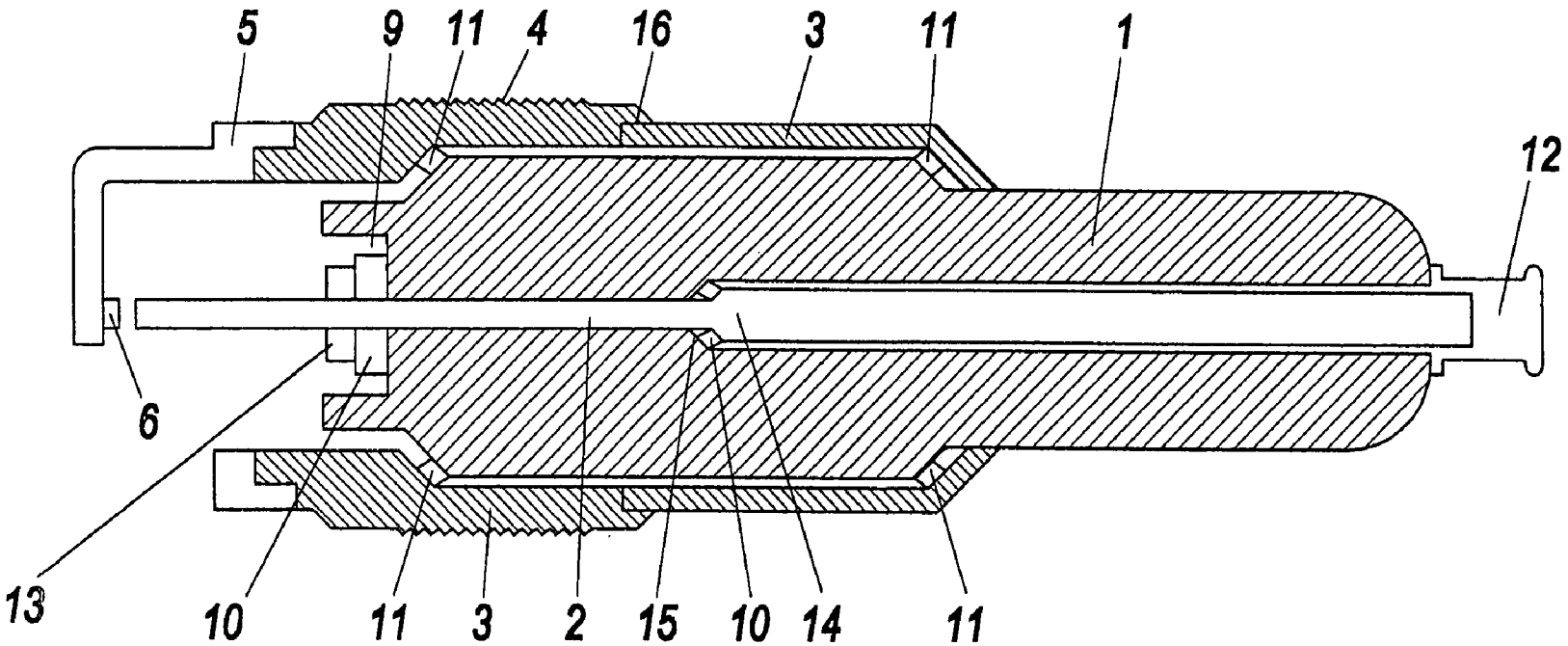

When arranging the sealing rings 10 according to the invention between the center electrode 2 and the insulator body 1, there are various alternatives according to the invention to the version represented in FIG. 1. FIG. 2 shows a spark plug in which no separate center electrode carrier 7 is used. In this example, an attachment ring 13 is pushed and/or pressed and/or welded onto the center electrode 2. The seal 10 can again be arranged or clamped in the recess 9 between this attachment ring 13 and the insulator body 1.

A particularly favorable process for the manufacture of a spark plug according to FIG. 1 or FIG. 2 provides that initially the center electrode 2 is pushed into the insulator body 1 with the addition of a seal 10. Finally, a second sealing ring 10 is pushed onto the center electrode 2 onto its side facing the combustion chamber, so that this sealing ring comes to rest in the recess 9 of the insulator body 1. As the next step, the center electrode carrier 7 with the already pre-welded electrodes 8 (preferably precious-metal electrodes) or the attachment ring 13 is pushed in the direction of the sealing ring 10 by a pressing device not further represented here. During this pressing process, the center electrode 2 is supported on the side facing away from the combustion chamber. A plastic deformation of the two sealing rings 10 results from this pressing process. In this prestressed state, the center electrode carrier 7 and/or the attachment ring 13 is welded to the center electrode 2 e.g. by means of laser (continuous or pulsed laser), TIG (WIG), plasma, resistance or electron-beam welding. As a result of this, firstly a seal is produced and secondly the center electrode carrier 7 is fixed and supported so that this arrangement is highly compression resistant and the center electrode 2 cannot be pushed out by the pressure in the combustion chamber. The use of laser welding is particularly favorable as here the components are welded in the prestressed pressing state, and the introduction of heat is limited to a very small, local area. In order to complete the spark plug, the thus-produced assembly comprising the insulator body 1, the center electrode 2 and the center electrode carrier 7 is fitted into the spark plug housing 3 with the addition of the seals 11. The spark plug housing 3 can be constructed from two parts which are compressed and welded together after the introduction of the insulator body in the area 16. Then the ground electrode carrier 5 is welded to the housing 3 in per se known manner, the ground electrodes 6 (preferably also made of precious metal) again being firstly welded to the ground electrode carrier 5. The use of an attachment ring 13 instead of or in addition to a center electrode carrier 7 has the advantage that the attachment ring 13 is less easily damaged upon pressing. Thus, by way of variation from FIG. 1 and FIG. 2, it can also be provided that the center electrode 2 is initially compressed with an attachment ring 13 and only then is the comparatively sensitive center electrode carrier 7 additionally attached to the end of the center electrode 2 that points to the combustion chamber.

As is demonstrated by the embodiments shown in FIGS. 1 and 2, there are numerous different variants for sealing off the center electrode 2 from the insulator body 1 using the sealing rings 10 in accordance with the invention, with the result that the invention is not limited to the embodiments shown.

Alternatively to the embodiments shown in FIGS. 1 and 2, the center electrode can also be pushed into the insulator body 1 from the combustion-chamber side end and be attached by corresponding rings or the like at the end of the insulator body 1 that faces away from the combustion chamber. In this case, it is favorable among other things if, instead of the center electrode 2 against which the sealing ring 13 or the center electrode carrier 7 sits in the embodiments shown, the center electrode itself has a larger diameter, so that a sealing ring 10 can again be clamped. The process outlined above for the manufacture of spark plugs can be adapted by a person skilled in the art within the meaning of the invention.

The invention claimed is:

1. Spark plug with an insulator body and a center electrode, wherein said center electrode is housed at least partially in a bore in said insulator body, said center electrode being sealed off from said insulator body by at least one sealing ring surrounding said center electrode, said sealing ring comprising material that is plastically deformable by compression, wherein said sealing ring rests against said insulator body externally at the end of the insulator body, which in the fitted position of the spark plug, points to a combustion chamber of an internal combustion engine.

2. Spark plug according to claim 1, wherein said sealing ring comprises at least one metal or one alloy of metals.

3. Spark plug according to claim 1, wherein said sealing ring comprises a metal from the group formed from soft irons and copper and nickel and high-grade steel, or aluminum materials or alloys of these materials.

4. Spark plug according to claim 1, wherein said sealing ring rests against the insulator body in a recess of same partially covering said sealing ring.

5. Spark plug according to claim 1, wherein a center electrode carrier being pushed or pressed or welded or the like onto the end of said center electrode, which in the fitted position, points to a combustion chamber of an internal combustion engine, and wherein said sealing ring is arranged or clamped between said center electrode carrier and said insulator body.

6. Spark plug according to claim 1, wherein an attachment ring being pushed or pressed or welded or the like onto the end of said center electrode, which in the fitted position, points to a combustion chamber of an internal combustion engine, and wherein said sealing ring is arranged or clamped between the attachment ring and the insulator body.

7. Spark plug according to claim 5, wherein said center electrode carrier is welded to said center electrode by continuous or pulsed laser welding or TIG welding or plasma welding or electron-beam welding or resistance welding.

8. Spark plug according to claim 1, wherein said center electrode comprises an area of enlarged diameter outside the insulator body at its end, which in the fitted position of said spark plug, points to the combustion chamber of an internal combustion engine and said sealing ring is arranged or clamped between said area with enlarged diameter and said insulator body.

9. Spark plug according to claim 1, wherein said sealing ring is arranged or clamped inside said insulator body between a shoulder of the insulator body, surrounding said center electrode, and an area of enlarged diameter of said center electrode.

10. Spark plug according to claim 1, wherein said insulator body is a ceramic insulator body.

11. Spark plug according to claim 1, wherein said center electrode is sealed off from said insulator body exclusively by at least one sealing ring surrounding said center electrode.

12. Spark plug according to claim 6, wherein said attachment ring is welded to said center electrode by continuous or pulsed laser welding or TIG welding or plasma welding or electron-beam welding or resistance welding.

13. Process for the manufacture of a spark plug according to claim 1 wherein the process comprises the following steps:

(a) introducing said center electrode into said bore provided for this in said insulator body, wherein at least one sealing ring or all sealing rings being arranged at the point provided for it (them); and (b) compressing said center electrode with said insulator body, said sealing ring(s) sealing off said center electrode from said insulator body and being plastically deformed.

14. Process according to claim 10, wherein during or after process step (b) a center electrode carrier or at least one attachment ring is pushed or pressed or welded onto the end of the center electrode, which in the fitted position of said spark plug, points to the combustion chamber of an internal combustion engine, said sealing ring sealing off between said center electrode carrier or the attachment ring on the one side and the insulator body on the other side, and being plastically deformed.

* * * * *